US005350227A

United States Patent [19]

Katz

[11] Patent Number: 5,350,227

[45] Date of Patent: Sep. 27, 1994

[54] SPACER FOR FILLING A SPACE BETWEEN TWO ADJACENT MODULAR CABINETS

[75] Inventor: Howard S. Katz, Riegelsville, Pa.

[73] Assignee: Robern, Inc., Bensalem, Pa.

[21] Appl. No.: 945,762

[22] Filed: Sep. 16, 1992

[51] Int. Cl.[5] ..... A47B 87/00

[52] U.S. Cl. ..... 312/198; 312/111; 312/140.4; 52/716.1

[58] Field of Search ..... 312/198, 111, 137, 140.1, 312/140.4, 265.1; 52/278, 468, 656.9, 716.1

[56] References Cited

U.S. PATENT DOCUMENTS

| | | | |
|---|---|---|---|
| 2,101,349 | 4/1934 | Sharp | 52/656.9 X |
| 2,599,322 | 6/1952 | Drain | 312/198 X |
| 3,351,400 | 11/1967 | Sholtes | 312/111 |
| 3,352,615 | 11/1967 | Sandin | 312/111 |
| 3,751,127 | 8/1973 | Black, Jr. et al. | 312/111 |
| 3,814,489 | 6/1974 | Clark et al. | 312/111 X |
| 4,831,804 | 5/1989 | Sayer | 52/656.9 X |

FOREIGN PATENT DOCUMENTS

| | | | |
|---|---|---|---|
| 296670 | 5/1965 | Netherlands | 312/111 |

*Primary Examiner*—Joseph M. Gorski

*Attorney, Agent, or Firm*—Panitch, Schwarze, Jacobs & Nadel

[57] ABSTRACT

A spacer fills a space between two adjacent modular cabinets. Each cabinet has side walls of a predetermined length and a predetermined width and a front wall. The cabinets are arranged such that at least one of the side walls of one of the cabinets is adjacent to and spaced by a first predetermined distance from at least one of the side walls of the other cabinet. The spacer includes at least one front filler having a length generally equal to the length of the adjacent side walls of the cabinets. The front filler has a generally central portion having a width generally corresponding to the first predetermined distance. The front filler is secured to the adjacent cabinets such that the two modular cabinets and the front filler form a single unit.

2 Claims, 2 Drawing Sheets

SPACER FOR FILLING A SPACE BETWEEN TWO ADJACENT MODULAR CABINETS

BACKGROUND OF THE INVENTION

The present invention relates to a spacer and, more particularly, to a spacer for filling a space between two adjacent modular cabinets.

Many modern bathrooms include more than one bathroom cabinet to accommodate additional storage space in the bathroom which is preferably generally hidden from view. While the novelty of multiple bathroom cabinets is appealing, a plurality of bathroom cabinets separately mounted on one or more walls of the bathroom can sometimes be considered to be unattractive or disjointed. Even if the bathroom cabinets are mounted relatively close together, many times gaps exist between adjacent cabinets for allowing a user to access the opening mechanism of each cabinet.

For example, if a cabinet is flush mounted, i.e., mounted within the wall, a gap is present between adjacent front walls of two or more of the cabinets. If the cabinets are surface mounted, i.e., mounted on the surface of the wall, then gaps are present both between the adjacent front walls of the cabinets as well as the adjacent side walls of the cabinets. These gaps detract from the modular appearance of the cabinets which as a result lowers the aesthetic appeal of the bathroom.

There is a need for a decorative spacer which can be placed between two or more modular cabinets to improve the appearance of the cabinets as being part of an individual unit. The spacer would fill the gap between the cabinets and still provide a space between the front surface of the spacer and the front wall of the cabinets to allow a user to have access to the opening mechanism of each cabinet.

SUMMARY OF THE INVENTION

Briefly stated, the present invention comprises a spacer for filling a space between two adjacent modular cabinets. Each cabinet has side walls of a predetermined length and a predetermined width and a front wall. The cabinets are arranged such that at least one of the side walls of one of the cabinets is adjacent to and spaced by a first predetermined distance from at least one of the side walls of the other cabinet. The spacer comprises at least one front filler having a length generally equal to the length of the adjacent side walls of the cabinets. The front filler has a generally central portion having a width generally corresponding to the first predetermined distance. The front filler includes attachment means for securing the front filler to at least one of the adjacent cabinets such that the two modular cabinets and the front filler form a single unit.

BRIEF DESCRIPTION OF THE DRAWINGS

The foregoing summary, as well as the following detailed description of the preferred embodiments, will be better understood when read in conjunction with the appended drawings. For the purpose of illustrating the invention, there is shown in the drawings embodiments which are presently preferred, it being understood, however, that the invention is not limited to the specific methods and instrumentalities disclosed. In the drawings.

DESCRIPTION OF THE PREFERRED EMBODIMENT

Figure 1:
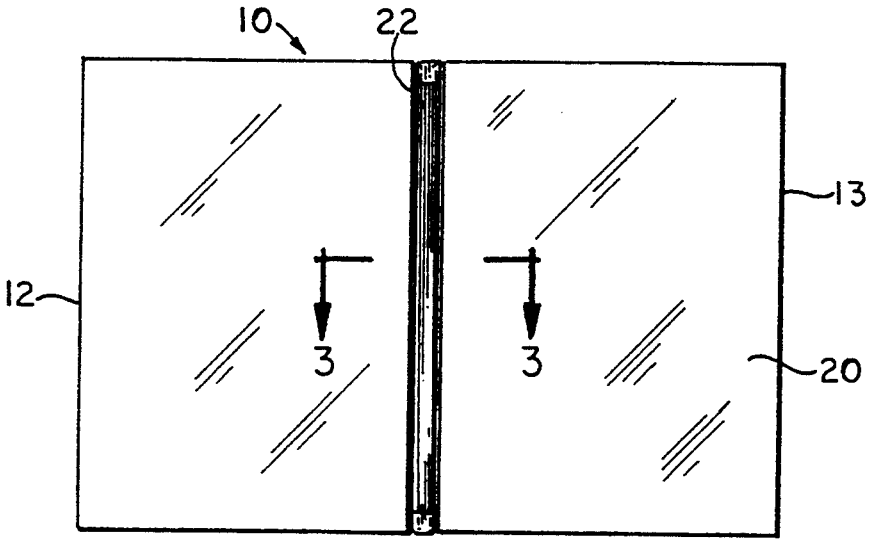
FIG. 1 is a front elevational view of a pair of modular cabinets mounted adjacent to one another horizontally and including a spacer in accordance with a first embodiment of the present invention.
Figure 2:
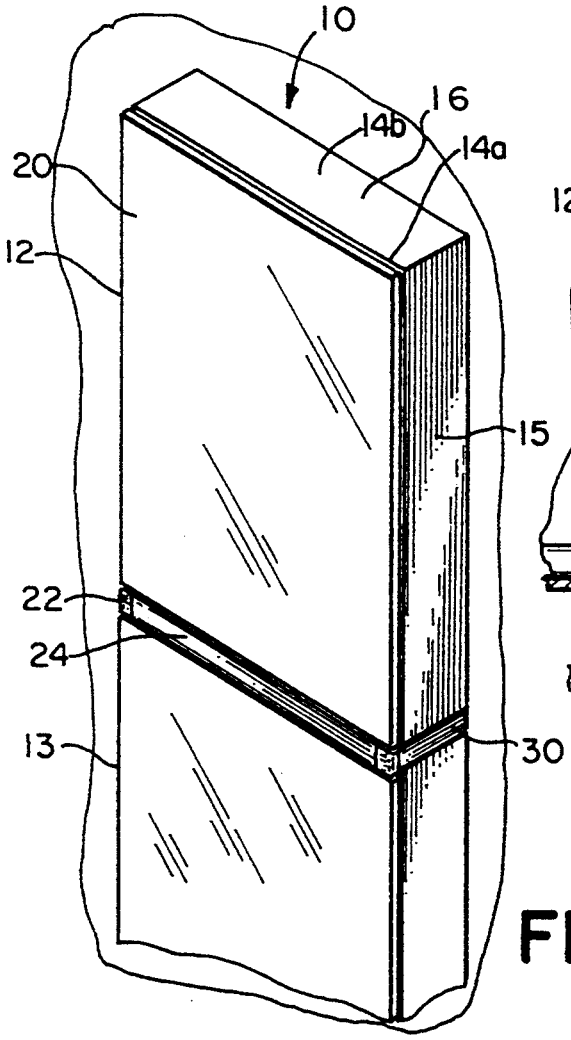
FIG. 2 is a perspective view of a pair of modular cabinets mounted adjacent to one another vertically and including a spacer in accordance with a second embodiment of the present invention.
Figure 3:
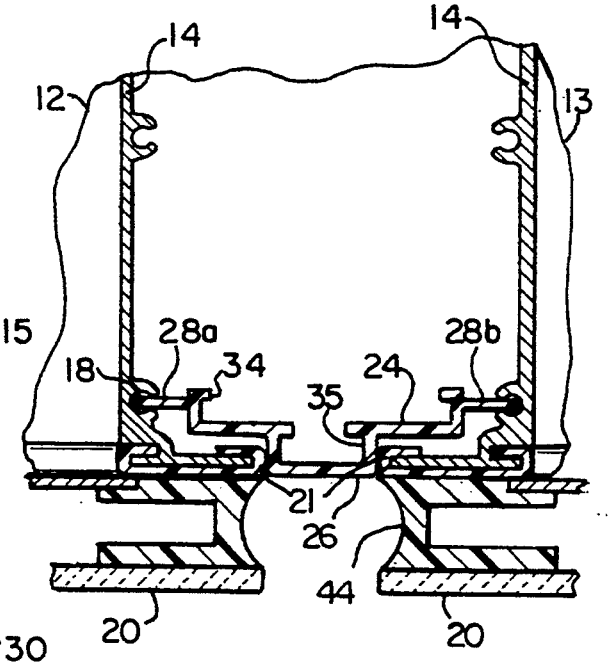
FIG. 3 is a cross sectional view of the cabinets and spacer taken along lines 3—3 of FIG. 1.

Referring to the drawings wherein like numerals indicate like elements throughout, there is shown in FIGS. 1–3 a modular unit 10 in accordance with the present invention. The unit 10 comprises a pair of cabinets 12, 13 which are mounted adjacent to one another. As shown in FIG. 1 the cabinets 12, 13 are mounted side by side, in a horizontal arrangement however, the cabinets 12, 13 can be mounted one on top of another in a vertical arrangement as shown in FIG. 2. It is to be understood by those skilled in the art that the cabinets 12, 13 may be arranged in any suitable configuration without departing from the scope and spirit of the present invention.

The cabinets 12, 13 may be flush mounted or surface mounted on a supporting wall. When the cabinets 12, 13 are flush mounted (not shown), the cabinets 12, 13 are mounted within a suitable opening within the supporting wall such that the front of each cabinet 12, 13 is generally flush with or extends just slightly beyond the surface of the wall. If the cabinets 12, 13 are surface mounted, as shown in FIG. 2, the cabinets are mounted on the wall such that the cabinets 12, 13 protrude outwardly from the surface of the wall by the depth of the cabinets.

Each cabinet 12, 13 preferably includes at least four side walls 14 (FIG. 3) which are connected together in a manner well known in the art to form a generally box-like frame 16. The side walls 14 can be connected by screws (not shown) which pass through predrilled holes in a first pair of opposite side walls 14 and semicircular lips (not shown) in a second pair of opposite side walls. The frame 16 is preferably rectangular and each side wall 14 has a predetermined length and width. However, it is to be understood by those skilled in the art that the frame 16 may be any suitable shape such as hexagonal or oval without departing from the scope and spirit of the present invention. In addition, each side wall 14 may be of equal length or unequal length such that opposite pairs of side walls 14 within the frame 16 are of equal length. The side walls may be made using known manufacturing techniques and/or materials but preferably are made of an extruded aluminum alloy. Each side wall 14 is preferably covered by a decorative mirror 15 as shown in FIG. 2 to provide a pleasing aesthetic appearance. The mirrors 15 are preferably generally the same width and length as the side walls 14 and are generally identical in appearance to that of the front wall 20. Further details concerning the structure of the cabinets 12, 13 may be obtained from U.S. Pat. No. 4,927,215 which is incorporated herein by reference.

The frame 16 of each cabinet 12, 13 preferably includes a lip 18 (FIG. 3) which extends along an outer perimeter. The lip 18 is preferably spaced a predetermined distance from a first edge 14*a* of one of the side walls 14 which is adjacent to a front wall 20 of the cabinet 12. The first edge 14*a* of each side wall 14 is encased in a plastic trim 21 which acts as a bumper to cushion the front wall 20. The front wall or cabinet door 20 is preferably connected to one of the side walls 14 of the frame 16 by hinges (not shown). A rear wall (not shown) is connected to a second edge 14*b* of each of the side walls 14. The side walls 14 and the rear wall are preferably made of the same material as the frame 16. The front wall 20 is preferably a mirror as shown in FIGS. 1 and 2. However, it is to be understood by those skilled in the art, that the front wall 20 of the cabinet 12 may be made out of any suitable material such as metal, wood or glass without departing from the scope and spirit of the present invention. Furthermore, the front wall 20 may comprise a double-sided mirror so that a mirrored surface is exposed when the front wall 20 is in an open position. A plastic trim edge 23 preferably surrounds the outer edges of the front wall and contains a groove 44 for allowing a user to insert a finger or thumb into the groove 44 to pivotally swing the front wall 20 in either an open or closed position.

The cabinets 12, 13 are arranged so that at least one of the side walls 14 of one of the cabinets 12 is adjacent to at least one of the side walls 14 of the other cabinet 13 as best shown in FIG. 3 with the cabinets 12,13 spaced apart by a first predetermined distance. The cabinets 12,13 are spaced apart to provide access to the groove 44 located within the plastic edge 23 so that a user can insert a finger or thumb into the groove 44 to open the cabinet. Preferably there should be enough space between the cabinets 12,13 so that a user can easily place his or her fingers within the groove 44.

Located between the two cabinets 12,13 is a spacer 22 which fills a space which exists between the two cabinets 12,13 to maintain even spacing between the two cabinets and to fill the gap between the cabinets 12,13 in an aesthetically pleasing manner while affording full access to any opening mechanisms on the front surfaces or doors of either or both of the cabinets 12,13. The spacer 22 comprises at least one front filler 24 which has a length generally equal to the length of the adjacent side walls 14 of the cabinets 12,13. When the cabinets 12,13 are mounted side by side as shown in FIG. 1, the front filler 24 is generally equal to the length of one of the vertical side walls 14 of the cabinet 12. When the cabinets 12,13 are mounted one on top of the other as shown in FIG. 2, the spacer 22 is generally equal to the length of one of the horizontal side walls 14 of the cabinet 12.

Figure 4:
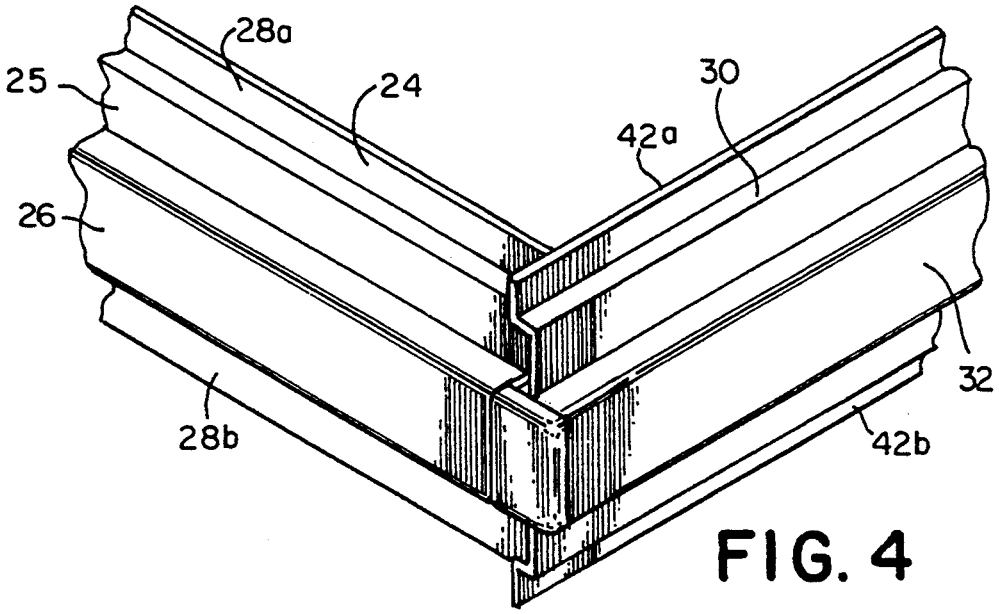
FIG. 4 is an enlarged perspective view of the spacer mounted between the cabinets of FIG. 2.
Figure 5:
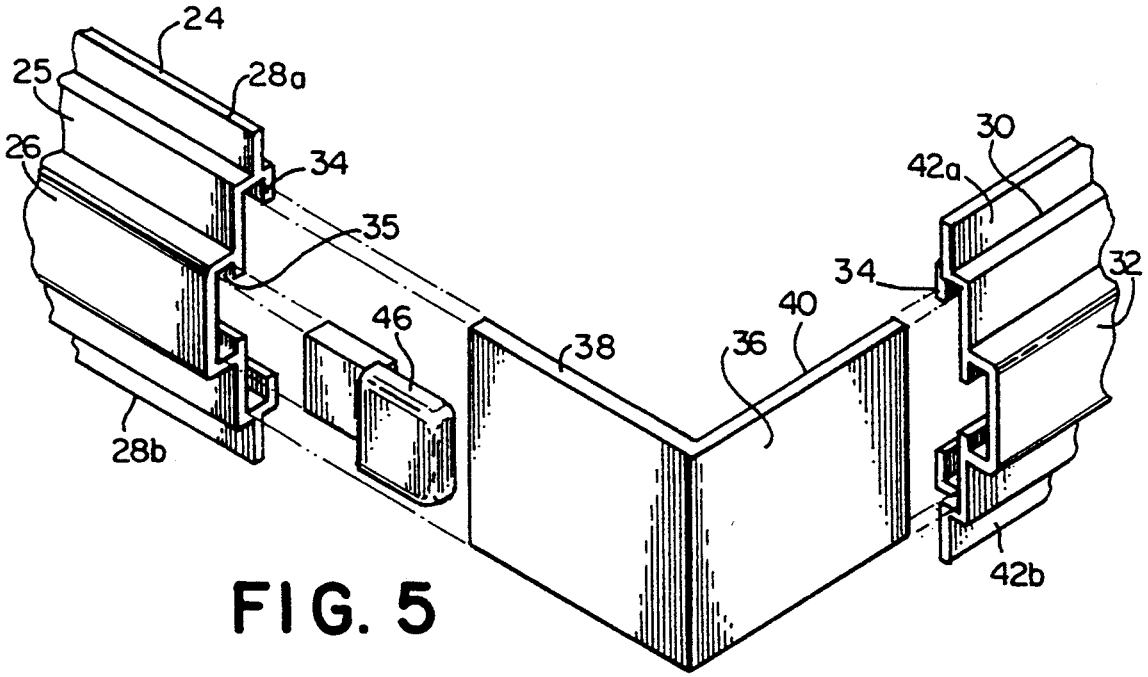
FIG. 5 is an exploded view of the spacer of FIG. 4.

Referring to FIGS. 3–5, the front filler 24 includes a generally central portion 26 having a width generally corresponding to the first predetermined distance between the adjacent side walls 14 and a predetermined depth. In the preferred embodiment, the depth of the front filler 24 at the central portion 26 is generally equal to the predetermined distance between the lip 18 and the first edge 14*a* of one of the side walls 14. The central portion 26 of the front filler 24 is generally smooth and is designed to present a border between the two cabinets 12,13.

The front filler 24 also includes a pair of tabs 28 which are generally parallel to and located on either side of the central portion 26. A first tab 28*a* is slidably received within the lip 18 in one of the adjacent side walls 14 of one cabinet 12 and a second tab 28*b* is slidably received within the lip 18 of the other cabinet 13. The tabs 28 are secured to the adjacent side walls 14 by any suitable means such as, but not limited to friction, epoxy or adhesive or another means sufficient to hold the tabs 28 in place within the lips 18.

When the cabinets 12,13 are flush mounted as shown in FIG. 1, the front filler 24 cooperates with the two adjacent cabinets 12,13 to form a finished aesthetically pleasing modular unit 10. A groove 44 (FIG. 3) is located between the top surface of the central portion 26 of the front filler 24 and the front wall 20 of each cabinet 12,13, for allowing a user to easily open and close each cabinet 12,13. The front filler 24 facilitates entry of a user's finger tip into the area between the cabinets 12,13 for this purpose.

If the cabinets 12,13 are surface mounted as shown in FIG. 3, side fillers 30 must be provided to fill a space between the mirror covered side walls 15 of the cabinets 12,13 as shown in FIG. 2. Each side filler 30 is preferably generally the same length as the width of the adjacent side wall 14 to which it is to be attached. Each side filler 30 includes a generally central portion 32 which is approximately the same width as the corresponding width of the central portion of the front filler 24. The side fillers 30 are preferably held in place by the side walls 15.

The side filler 30 fills the gap formed by the cabinets 12,13 in an aesthetically pleasing manner. In the preferred embodiment, the front filler 24 and side fillers 30 are made from the same material and are the same color to provide uniform appearance and to add to the illusion of a single unit. The front filler 24 and the side fillers 30 may also be the same color as the plastic trim 21 and plastic edge 23.

Each side filler 30 and the front filler 24 include a pair of generally parallel grooves 34 which are located on an underside of each filler 30, 24. The grooves 34 extend approximately the width of each filler 24, 30. The grooves 34 are designed to receive an attaching means for attaching the side fillers 30 to the front filler 24. The attaching means is preferably an L-shaped bracket 36. The bracket 36 is preferably made out of a rigid material such as, but not limited to steel, aluminum, plastic or any other suitable material.

The bracket 36 comprises a first wall 38 and a second wall 40, each of the walls 38, 40 having a width which generally corresponds to the distance between the grooves 34 of the front and side fillers 24, 30. The first wall 38 is slidably received within the grooves 34 in the front filler 24. The second wall 40 is slidably received within the grooves 34 of one of the side fillers 30. As a result, the front filler 24 and the one side filler 30 are adjacent one another at an angle preferably generally equal to the angle between the first and second walls 38, 40 of the bracket 36. In the preferred embodiment, the angle between the first and second walls 38, 40 and thus the angle between the front filler 24 and the one side filler 30 is approximately 90°. However, it is to be understood by those skilled in the art that the angle between the first and second walls 38, 40 may be any suitable angle without departing from the scope and spirit of the present invention. Once the front filler 24 and the one side filler 30 are attached together, a cap 46 is inserted into a slot 35 located in the end of the front filler 24 which is adjacent the side filler 30. The cap 46 provides a finished look to the spacer 22 and provides a smooth corner edge. The other side filler 30 is attached to the front filler in the same manner using a second bracket 36 and a second cap (not shown) 46.

In use, when the spacer 22 is to be used with the pair of cabinets 12,13 one of the cabinets 12,13 is first mounted to the wall. In the case where the cabinets 12,13 are vertically stacked, the bottom cabinet 13 is installed first. Once the bottom cabinet 13 has been mounted to the wall, in the case of surface mounting, the front filler 24 and the side fillers 30 are attached together by the L-shaped brackets 36. The front filler 24 is inserted into the lip 18 located on the side wall 14 of the bottom cabinet 13. Once the front filler 24 and side fillers 30 are properly secured to the bottom cabinet 13, the top cabinet 12 is mounted over the bottom cabinet 13 and the first tab **28*a* is received within the lip 18 of the top cabinet 12. The side fillers 30 are contained between the cabinets 12, 13 and the side wall 15. Once the top cabinet 12 has been installed, the bottom and top cabinet 12,13 appear as a modular unit 10 with the spacer 22 located therebetween. A space is provided between the spacer 22 and the front wall 20 of each cabinet 12 in order to allow a user to access a groove 44 located within the front wall 20 for opening and closing the cabinet 12. The side fillers 30 provide a finished look to the unit 10 and compliment the front filler 24**.

From the foregoing description, it can be seen that the present invention comprises a spacer for filling a space between two adjacent modular cabinets. It will be appreciated by those skilled in the art that changes could be made to the embodiment described above without departing from the broad inventive concepts thereof. It is understood, therefore, that this invention is not limited to the particular embodiments disclosed, but is intended to cover all modifications which are within the scope and spirit of the invention as defined by the appended claims.

I claim:

1. A combination of two adjacent modular cabinets and a spacer for filling a space between the cabinets, the combination comprising:

two adjacent cabinets, each cabinet having side walls, including side wall edges, the side walls having a predetermined length and a predetermined width, and a front wall, the cabinets being arranged such that at least one of the side walls of one of the cabinets is adjacent to and spaced by a first predetermined distance from at least one of the side walls of the other cabinet to form a space therebetween;

at least one front filler positioned in the space between the cabinets, the front filler having a length generally equal to the length of the adjacent side walls of the cabinets, a generally central portion having a width generally corresponding to the first predetermined distance, and a pair of generally parallel grooves located on an underside thereof extending the length of the filler and being located within the space between the cabinets, the front filler including attachment means for securing the front filler to at least one of the adjacent cabinets such that the two modular cabinets and the front filler form a single unit, with the front filler and the side wall edges of the adjacent cabinets being coplanar, at least one side filler positioned in the space between the cabinets, the side filler having a length generally equal to the width of at least one of the adjacent sidewalls, a generally central portion having a width generally corresponding to the width of the central portion of the front filler, and a pair of generally parallel grooves located on an underside thereof extending the length of the side filler and being located within the space between the cabinets, the side filler including attachment means for securing the side filler to at least one of the adjacent cabinets, with the side filler and the side wall edges of the adjacent cabinets being coplanar; and attaching means for attaching said front filler to said side filler, the attaching means including a first wall and a second wall wherein the second wall is at an angle with respect to the first wall, the first wall being received within the grooves of the front filler and the second wall being received within the grooves of the side filler such that the front filler and the side filler are adjacent one another at an angle equal to the angle between the first and second walls of the attaching means, wherein the cabinets, the front filler and the side filler form a single unit in which the central portion of the side filler is adjacent the adjacent side walls of each cabinet and the front filler is adjacent the front walls of each cabinet.

2. A combination of two adjacent modular cabinets and a spacer for filling a space between the cabinets, the combination comprising:

at least two surface mounted modular cabinets, each cabinet including side, front and rear walls, and each wall having an edge, said side walls being connected to form a frame, said cabinets arranged to form a modular unit, said cabinets being arranged such that at least one of the side walls of the first cabinet is adjacent to and spaced by a first predetermined distance from at least one of the side walls of the second cabinet to form a space therebetween;

at least one front filler having a length generally equal to the length of the adjacent side walls of the cabinets, the front filler having a front surface and a back surface, the front surface of the front filler having a generally central portion having a width generally corresponding to the first predetermined distance, the back surface of the front filler including a pair of grooves which extend along the length of the front filler and being located within the space between the cabinets, the front filler including attachment means for securing the front filler to at least one of the adjacent cabinets;

at least one side filler having a length generally equal to the width of one of the adjacent side walls, the side filler having a generally central portion having a width generally corresponding to the width of the central portion of the front filler, the side filler including a pair of grooves located on a back surface of the side filler extending across the length thereof and being located within the space between the cabinets, the side filler including attachment means for securing the side filler to at least one of the adjacent cabinets; and attaching means for attaching said front filler to said side filler, the attaching means including a first wall and a second wall which is generally perpendicular thereto, said first wall being slidably received within the grooves of the front filler and the second wall being received within the grooves of the side filler, wherein the central portions of the front filler and the side filler are placed adjacent to the first and second cabinets with said fillers and the adjacent cabinet side wall edges being coplanar, to thereby form the modular unit.

* * * * *